United States Patent [19]

Farrell et al.

[11] Patent Number: 4,552,171

[45] Date of Patent: Nov. 12, 1985

[54] SUPPLY CONDUIT MOUNTING ASSEMBLY FOR SINGLE LEVER FAUCET

[75] Inventors: Gerald J. Farrell, Elmhurst; Rudy Y. Bisonaya, Oaklawn, both of Ill.

[73] Assignee: Elkay Manufacturing Company, Broadview, Ill.

[21] Appl. No.: 487,823

[22] Filed: Apr. 22, 1983

[51] Int. Cl.[4] ..... F16L 5/00

[52] U.S. Cl. ..... 137/359; 137/801; 4/192

[58] Field of Search ..... 137/601, 359, 801, 625.4, 137/454.2; 4/192

[56] References Cited

U.S. PATENT DOCUMENTS

| | | | |
|---|---|---|---|
| 3,559,690 | 2/1971 | Palmer | 137/801 |
| 3,807,453 | 4/1974 | Dom et al. | 137/359 |
| 3,938,546 | 2/1976 | Farrell | 137/359 |
| 4,393,523 | 7/1983 | Nolden | 4/192 |
| 4,446,885 | 5/1984 | Nolden | 137/359 |

OTHER PUBLICATIONS

"Single Lever Lavatory Faucet", Bradley Manufacturing Corp., Menomonee Falls, Wisconsin, 1983.

*Primary Examiner*—A. Michael Chambers

*Attorney, Agent, or Firm*—Leydig, Voit, Osann, Mayer and Holt, Ltd.

[57] ABSTRACT

A supply conduit mounting assembly is disclosed for a single lever faucet. In assembled condition, the hot and cold water supply conduits are connected to the valve body of the faucet and rigidly held from movement relative to the valve body by a plate which serves as a structural member for mounting the valve body and connecting the end sections of the supply conduits to the valve body without threaded fittings or brazing. Resilient O-rings associated with the ends of the supply conduits provide a water-tight seal adjacent the junction of the supply conduits and the valve body bores and thereby prevent water from coming into contact with the mounting plate, which may be a low cost die casting of metal which is not required to be corrosion resistant.

7 Claims, 9 Drawing Figures

2
12
32
28
14
58
53
50
56
26
16
58
45
56
55
30
1
55
44
34
52
50
10
2
12
32
57
57
14
50
53
28
16
18
19
49B
45
46
30
38
48
38
34
3
54
44
52
50
3
40
42
36
10
11
42
40
36
1
49B
16
44A
49A
18
45
49
48

SUPPLY CONDUIT MOUNTING ASSEMBLY FOR SINGLE LEVER FAUCET

TECHNICAL FIELD

This invention relates to faucets and, more particularly, to a mounting assembly for supply conduits to single lever faucets.

BACKGROUND ART

Heretofore, various arrangements have been utilized to connect the supply conduits to the valve body of a single lever faucet. In typical constructions, the valve body is fastened to a faucet escutcheon or housing and hot and cold water supply conduits of copper tubing are connected to the valve body by brazing or threaded fittings in such a manner that they are rigidly held and sealed in place. The valve bodies of single lever faucets in many prior designs have been made of brass so as to provide a strong member to which the hot and cold water supply conduits may be connected and to provide corrosion resistant waterways leading from the supply conduits. In such typical constructions, the cost of both the brass and its fabrication are high and, therefore, a need exists for a lower cost construction having equivalent strength and corrosion resistance. Threaded fittings can be difficult and time consuming, resulting in higher costs for faucets, and the machining and finishing operations involved in manufacturing valve bodies or fittings where brazing or mechanical fastening means are utilized also increases costs.

DISCLOSURE OF THE INVENTION

The principal object of this invention is to provide an improved single lever faucet having a mounting assembly for mechanically connecting the supply conduits to the valve body of a single lever faucet so as to achieve lower costs of manufacture and installation than prior designs.

More specifically, an important object is to reduce costs of single lever faucets by eliminating the need for a brass valve body which is traditionally utilized to provide the requisite structural strength to have the supply conduits connected by brazing or threaded fittings and the necessary corrosion resistance to withstand direct contact with water in the waterways.

Another object of this invention is to provide a mounting assembly for connecting the supply conduits to the valve body of a single lever faucet which utilizes the faucet escutcheon as one of the mounting assembly components and a mounting plate for mechanically interconnecting the valve body and water supply conduits.

Another object is to provide an improved single lever faucet which, while constructed of lower cost and more easily fabricated material, has the requisite strength and corrosion resistance to provide troublefree long life in normal use, such as in lavatory faucets.

BRIEF DESCRIPTION OF THE DRAWINGS

Further objects will become apparent from the following description taken in connection with the accompanying drawings, wherein:

FIG. 2 is a sectional view taken along irregular line 2—2 in FIG. 1;

BEST MODE FOR CARRYING OUT THE INVENTION

Figures 1, 2A, 2B:
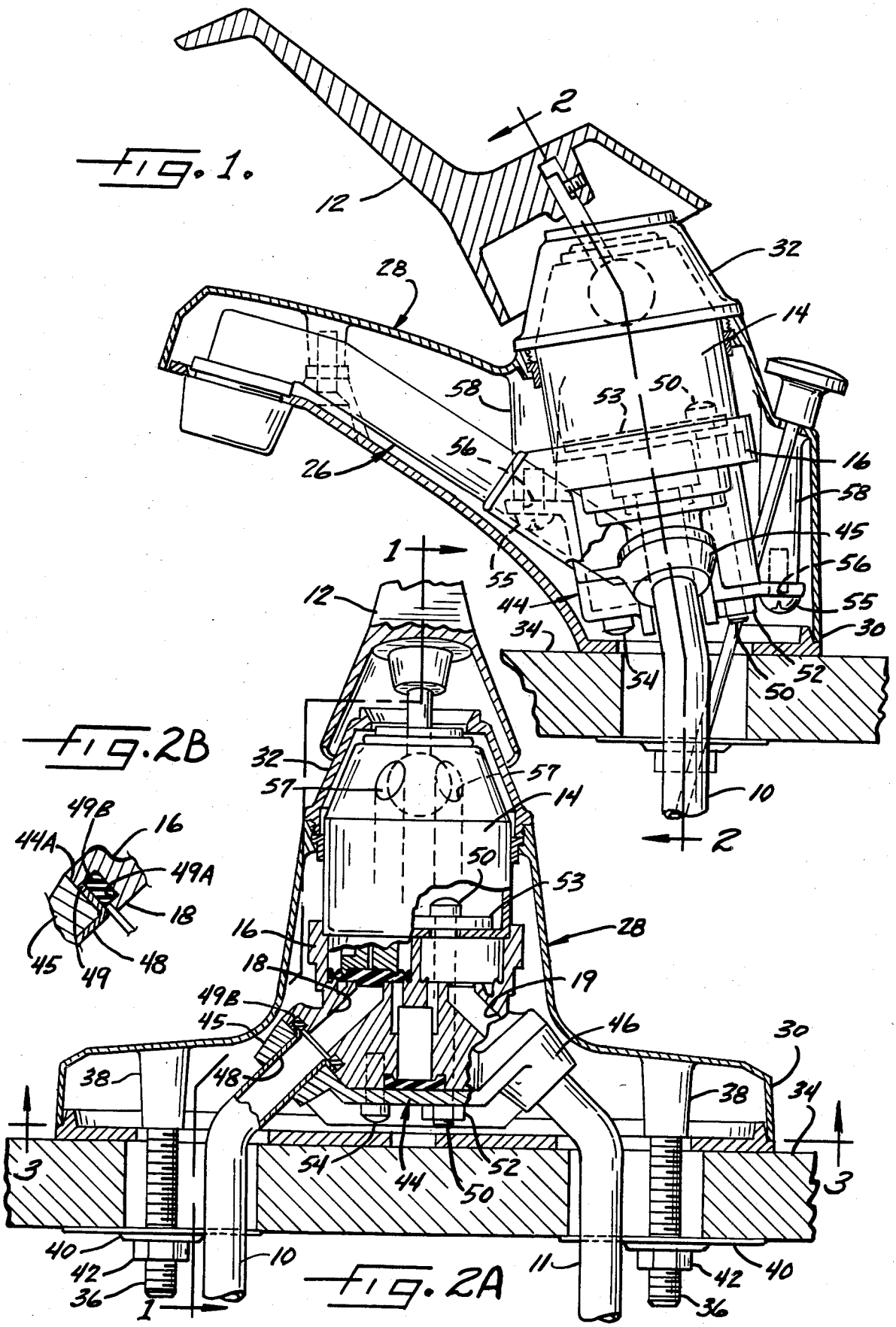
FIG. 1 is a sectional view of a single lever faucet embodying the mounting assembly of this invention taken along irregular line 1—1 of FIG. 2.

FIGS. 1 and 2 generally show a single lever faucet which is adapted to be supplied with hot and cold water by conduits 10, 11. These conduits are made of bendable corrosion resistant tubing, preferably copper, stainless steel or plastic. The faucet is actuated by the single lever 12. This lever is preferably attached to a cam and piston valve mechanism as described in commonly assigned U.S. Pat. No. 4,357,957, although other mechanisms may be used. The valve mechanism is contained within a valve body having a cartridge section 14 mounted on a base section 16, both of which are preferably molded plastic parts. The base section 16 of the valve body is provided with bores 18, 19, best shown in FIG. 2, abutting the ends of the water supply conduits 10, 11 to receive water flowing into the valve body from the supply conduits.

The faucet includes a spout tube assembly, generally indicated by reference numeral 26, which extends through and is oriented and securely held in a hollow housing or escutcheon 28. As best seen in FIG. 2, the housing or escutcheon is formed by a base member 30 and a cover 32 which are made by molding or die-casting plastic or metal. The base member is adapted to rest on the surface 34 of a sink adjacent the bowl in the customary centered location. For mounting the housing or escutcheon on the sink, hold-down studs 36 are carried by downwardly extending integral threaded bosses 38. Washers 40 present bearing surfaces to the underside of a countertop or other unit on which the sink is mounted, and locking nuts 42 complete the hold-down means by which the housing or escutcheon 28 may be secured to a sink. The housing or escutcheon 28 is hollow to form a chamber for the cartridge and valve body base section 16. While the housing or escutcheon 28 may be made from various materials, die case zinc is preferred for its high impact strength and toughness. This material provides the strength required for securing the other components of the faucet.

Figure 3:
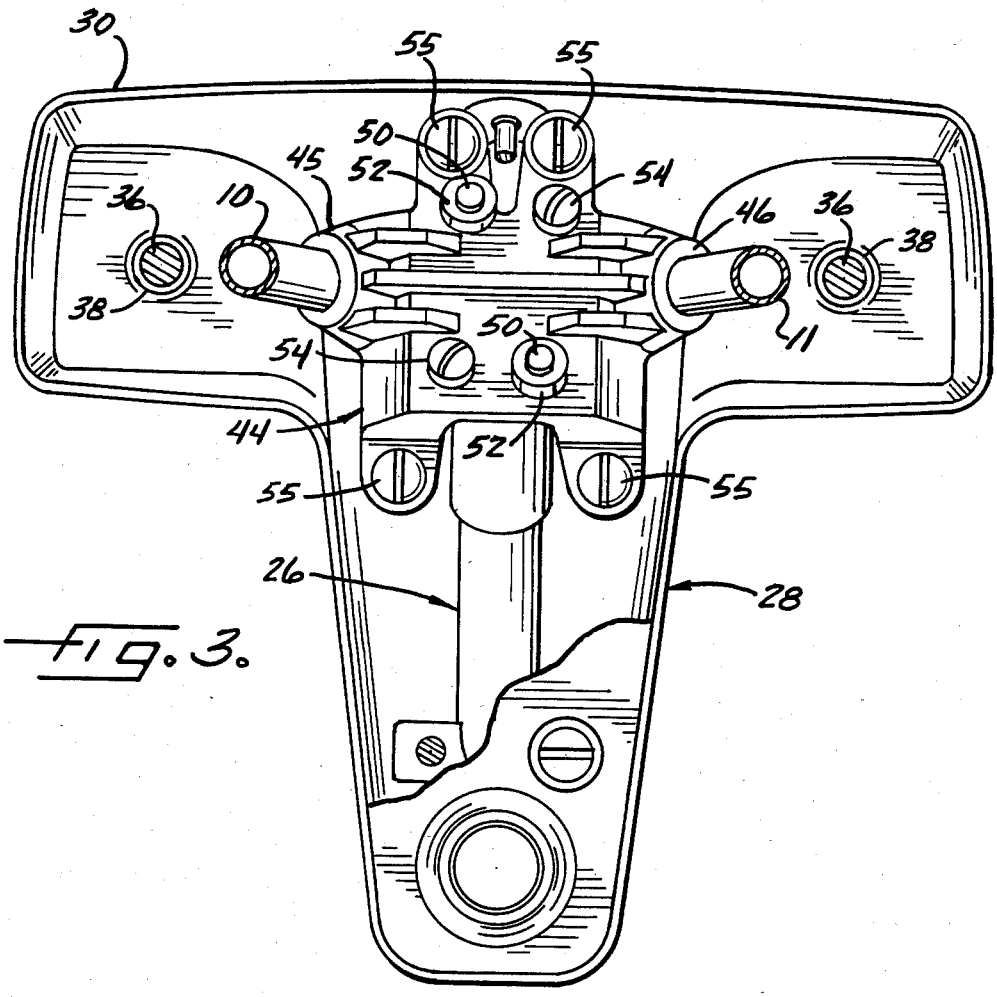
FIG. 3 is a bottom view taken along the plane of line 3—3 in FIG. 2.

In carrying out the invention, there is provided a mounting plate 44, best seen in FIGS. 2 and 3, adapted to be fastened to the faucet escutcheon 28 for carrying the valve body base section 16 and the cartridge 14 within the escutcheon 28 and for connecting the water supply conduits 10, 11 with the ends of the conduits abutting the bores 18, 19 in the base of the valve body. According to this invention, the mounting plate may be made of low cost die cast metal, such as zinc, and is fastened to the base of the valve body with sealing means that insures that water cannot contact the mounting plate. Instead of the valve body comprising a structural member as in many prior designs, with the present invention the mounting plate provides the structural strength required to support the valve base, cartridge and supply conduits in position, yet may be made of low cost material which is not required to be corrosion resistant since it does not come into contact with water in the waterways.

Accordingly, the mounting plate, as seen in FIG. 2, has portions engaging sections of the water supply conduits 10, 11 adjacent the ends of the conduits and mechanically gripping the conduits to hold them connected with the valve body without requiring a brazed connection or a threaded fitting. For this purpose, the plate 44 is formed with two flanges 45, 46, one at each end of the plate. Each flange has a bore 48 aligned with one of the bores 18, 19 of the valve body and the end sections of the supply conduits 10, 11 are received in the bores 48. To mechanically grip the conduits 10, 11, their ends are flared outwardly against the face 44A of the mounting plate by a swaging operation during assembly, causing the material of the mounting plate to stretch slightly and exert a compressive force against the conduits and mechanically grip them and hold them rigidly and against rotation or other relative movement.

Circular grooves 49 in the base of the valve body surrounding the bores 18, 19, including counter bore sections 49A, are provided for receiving the flared ends of the supply conduits 10, 11 and O-rings 49B which seal the waterways provided by the supply conduits 10, 11 and the bores 18, 19. The O-rings 49B engage the inside surfaces of the flared ends of the supply conduits 10, 11, thus sealing off the mounting plate 44 from contact with water in the waterways.

For the purpose of securing the cartridge 14 to the base section 16 of the valve body, screws 50 are used which pass through the base section 16 of the valve body and are received in threaded nuts 52 under the bracket 44. A plate 53 under the heads of the screws 50 secures the cartridge 14 to the base 16 of the valve body. Access to the heads of the screws 50 is provided through access holes 57 in the cartridge 14, for removing the screws, allowing removal of the cartridge through the open upper end of the faucet housing, wiht the cover 32 removed. This arrangement facilitates replacement of the cartridge.

For fastening the base 16 of the valve body on the mounting plate 44, screws 54 are used. For securing the mounting plate 44 to the escutcheon 28, screws 55, which extend through bores 56, are received by the escutcheon in downwardly extending integral threaded bosses 58 (see FIG. 1).

Figure 4:
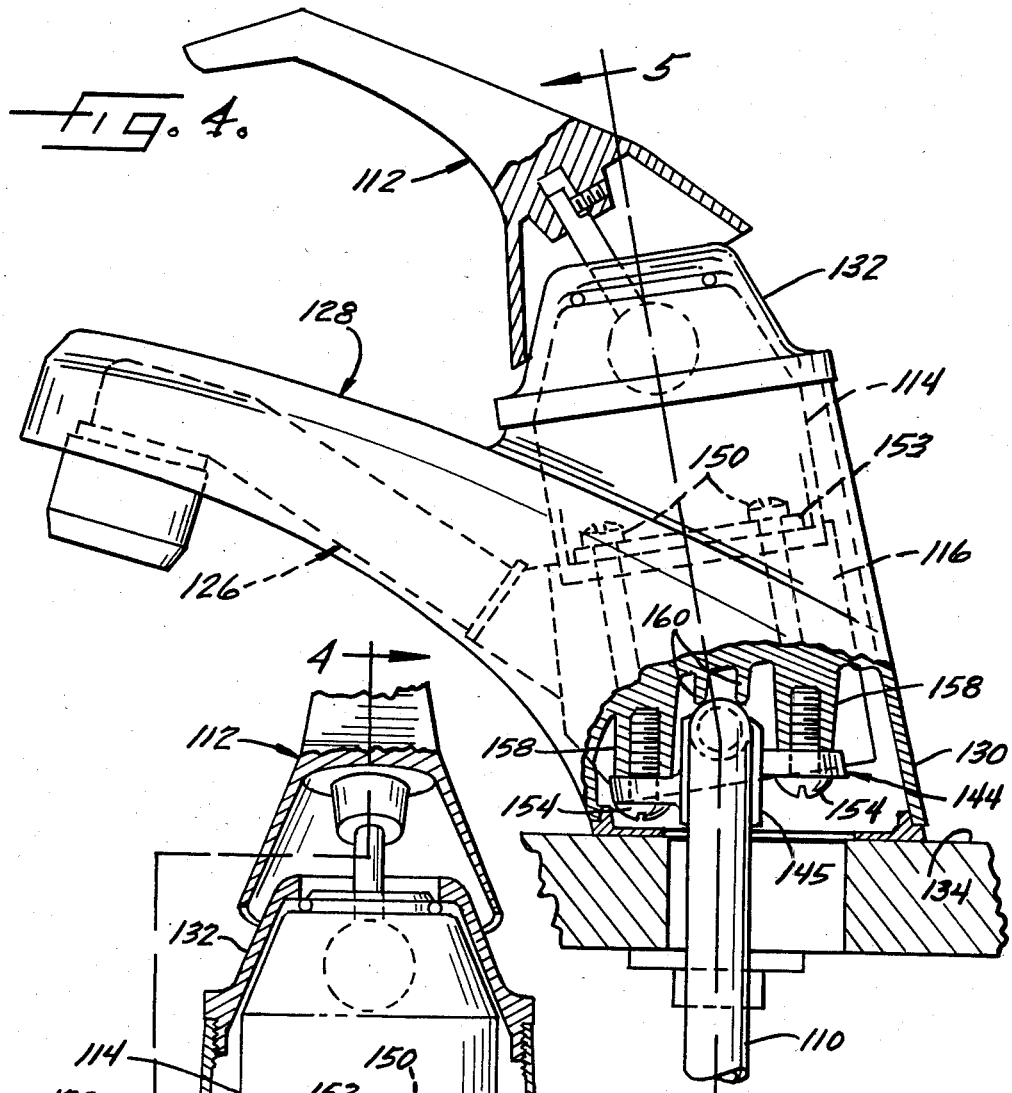
FIG. 4 is a sectional view similar to FIG. 1 of a single lever faucet embodying an alternative embodiment of the mounting assembly of this invention.
Figure 5:
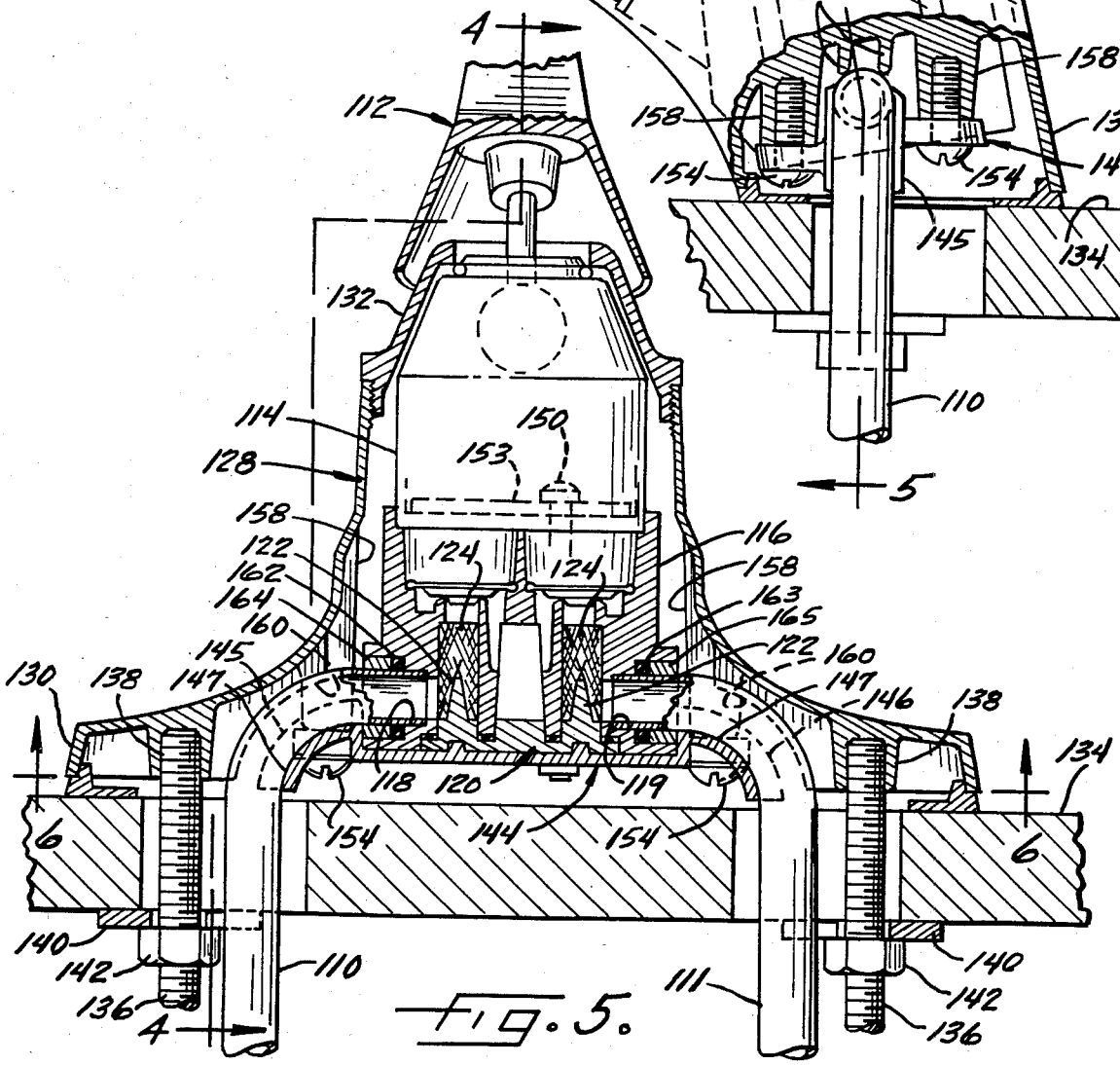
FIG. 5 is a sectional view taken along irregular line 5—5 in FIG. 4.
Figure 6:
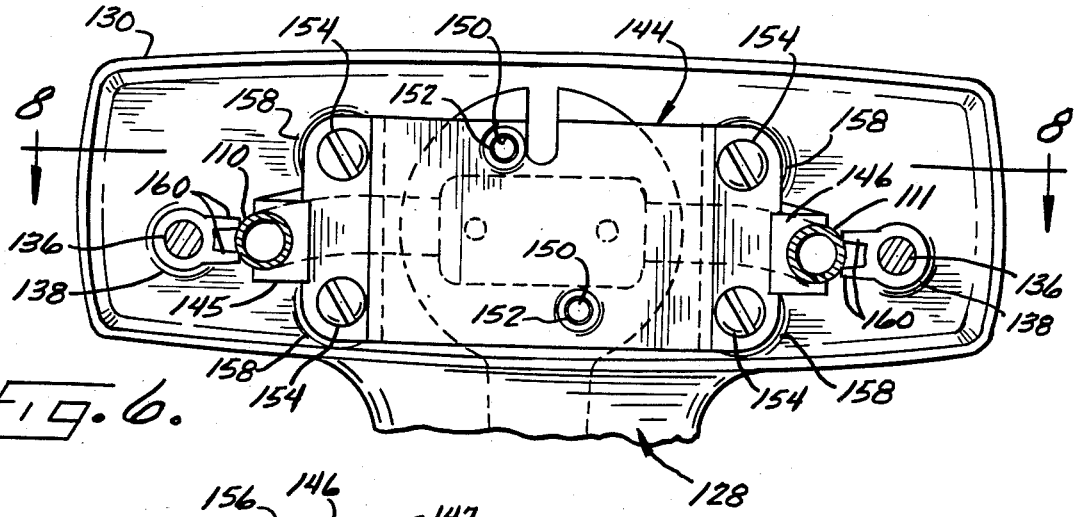
FIG. 6 is a bottom view taken along the plane of line 6—6 in FIG. 5.
Figure 7:
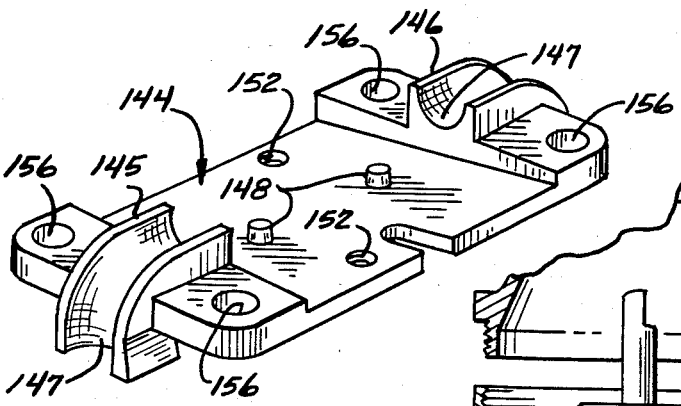
FIG. 7 is a perspective view of the mounting plate.
Figure 8:
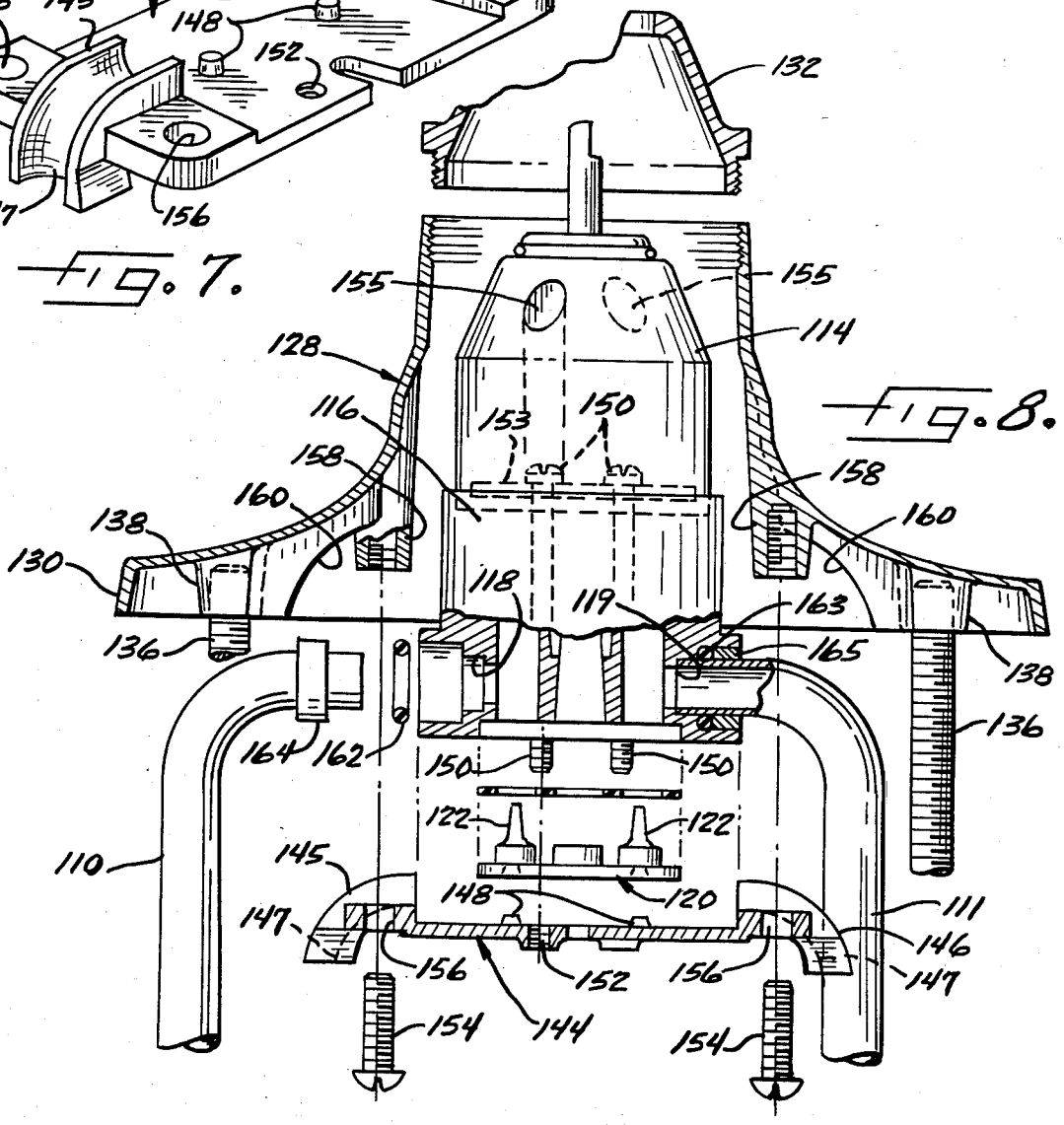
FIG. 8 is an exploded sectional view along the plane of line 8—8 of FIG. 6.

Thus it is apparent that there has been provided, in accordance with the invention, a mounting assembly for a single lever faucet that fully satisfies the objects set forth above. While the invention has been described in conjunction with a specific embodiment thereof, it is evident that alternatives, modifications and variations will be apparent to those skilled in the art in light of the foregoing description. As an illustration of an alternative embodiment, reference is made to FIGS. 4–8. Accordingly, it is intended that this invention encompass all such alternatives, modifications and variations which come within the spirit of the appended claims. In FIGS. 4 and 5, a single lever faucet is shown generally which is adapted to be supplied with hot and cold water by conduits 110, 111. These conduits, as in the prior form of the invention, are made of bendable, corrosion resistant tubing, prefereably, copper, stainless steel or plastic. The faucet is actuated by the single lever 112. Preferably, this lever 112 is attached to a cam and piston valve mechanism as described in said U.S. Pat. No. 4,357,957, although other mechanisms may be used. As in the prior embodiment of the invention, the valve mechanism for the faucet is contained within a valve body having a cartridge section 114 mounted on a base section 116. Bores 118, 119 in the base section 116 of the valve body are sized to receive the ends of water supply conduits 110, 111. Adjacent these bores 118, 119 is a removable plate 120 which has a pair of laterally spaced bosses 122, best seen in FIGS. 5 and 8, which support filter screens 124. These screens strain the hot and cold water before it flows through the valves.

The spout tube assembly indicated by the reference numeral 126 extends through and is oriented and securely held in a hollow housing or escutcheon 128. The housing or escutcheon 128 is formed by a base member 130 and a cover 132, the base member being adapted to rest on the sink surface 134. For mounting the housing or escutcheon on the sink, hold down studs 136 are carried by downwardly extending integral threaded bosses 138. Washers 140 present bearing surface to the underside of a countertop and locking nuts 142 are utilized to secure the escutcheon 128 to a sink. A chamber is formed within the housing 128 for the cartridge and base section 116.

For carrying out the invention, as in the prior embodiment, a mounting plate 144 is adapted to be fastened to the faucet escutcheon 128 to serve as a structural member for carrying the base section 116 and the cartridge 114 within the housing or escutcheon 128 and for mechanically connecting the water supply conduits 110, 111 with the ends of the conduits received in the bores 118, 119 of the base of the valve body. In this case, the plate 144 is formed with two saddles 145, 146, one at each end of the plate. Each saddle has a half-round groove 147 with an inside diameter slightly larger than the outside diameter of the water supply conduits 110, 111. The grooves 147 traverse an arc of approximately ninety degrees and terminate at a point which, when the faucet is assembled and the mounting plate is fastened to the faucet escutcheon, is adjacent and coaxially aligned with one or the other water supply conduit receiving bores 118, 119 which themselves are substantially aligned in the base 116 of the valve body. The plate 144 is additionally formed with studs 148 onto which the filter screen supporting boss plate 120 is seated during assembly.

Screws 150 are used to secure the cartridge 114 to the base section 116, which screws 150 pass through the base section 116 and are received in threaded bores 152 in the plate 144. A plate 153 under the heads of the screws 150 secures the cartridge 114 to the base 116. Access to the heads of the screws 150 is provided through access holes 155 in the cartridge 114 for a screwdriver to remove the screws, allowing removal of the cartridge through the open upper end of the faucet housing or escutcheon with the cover 132 removed.

To mechanically grip the water supply conduits 110, 111 with the ends of the conduits abutting the bores 118, 119 in the base of the valve body, the plate 144 is fastened to the housing or escutcheon 128 by screws 154 which extend through bores 156 and are received by the escutcheon in downwardly extending threaded bosses 158 integral with the escutcheon. In keeping with the invention, the housing or escutcheon 128 is formed with pairs of curved support ribs 160. When the ends of the supply conduits 110, 111 are in place in the bores 118, 119 of the base of the valve body and the plate 144 is fastened to the housing 128, the end sections of the conduits 110, 111 are securely and rigidly gripped between the saddles 145, 146 and the support ribs 160. Thus, in its assembled condition, the supply conduits are sandwiched between the housing or escutcheon 128 and the plate 144 with their terminal ends fixed in the bores 118, 119 of the lower section 116 of the valve body. Because the supply conduits 110, 111 are held against movement relative to the valve body, their terminal ends are not distorted and resilient O-rings 162, 163 can be utilized to provide a water-tight seal at the junction of the supply conduits 110, 111 and the valve body bores 118, 119. It will also be noted that the O-rings seal the mounting plate from contact with water in the waterways, which is desirable where the mounting plate is a corrosive metal, such as zinc. Such O-rings 162, 163 are assembled in place with the aid of rings 164, 165 pressed onto the supply conduits 110, 111.

We claim:

1. A single lever faucet adapted to be supplied by spaced hot and cold water supply conduits, said faucet comprising an escutcheon having support members formed on the interior thereof, a valve body having bores for receiving water from the ends of said water supply conduits, a mounting plate fastened to said support members of said escutcheon, means for securing said valve body to said mounting plate, said valve body providing first sealing surfaces adjacent the bores therein, said ends of said conduits being flared outwardly and forming inside surfaces providing second sealing surfaces facing said first sealing surfaces, said mounting plate having portions engaging sections of said water supply conduits adjacent said flared ends and mechanically gripping said sections to hold said flared ends of said supply conduits adjacent said valve body with the insides of said supply conduits connected to said valve body bores to provide continuous waterways, and sealing means including sealing elements between said first and second sealing surfaces adjacent the junction of said supply conduits and said valve body bores to seal said waterways from said mounting plate to prevent contact thereof with water in said waterways.

2. A single lever faucet according to claim 1 in which said sealing means elements comprise O-rings for sealing between said first and second sealing surfaces adjacent the junction between the valve body bores and the water supply conduits.

3. A single lever faucet according to claim 1 in which said sealing means includes O-rings for sealing adjacent the junction between the valve body bores and the water supply conduits.

4. A single lever faucet adapted to be supplied by spaced hot and cold water supply conduits, said faucet comprising an escutcheon having support ribs formed on the interior thereof, a valve body having bores for receiving water from the ends of said water supply conduits, a mounting plate fastened to said support ribs of said escutcheon, means for securing said valve body to said mounting plate, said plate having saddles which coact with said support ribs for mechanically gripping sections of said water supply conduits adjacent said ends and mechanically gripping said sections to hold said ends of said supply conduits connected to said valve body bores to provide continuous waterways, and sealing means adjacent the junction of said supply conduits and said valve body bores to seal said waterways from said mounting plate to prevent contact thereof with water in said waterways.

5. A single lever faucet according to claim 4 in which said bores in said valve body are aligned and said saddles and support ribs are formed to clamp curved sections adjacent said ends of said supply conduits so that said conduits are adapted to enter and be sealingly received in said aligned bores in said body.

6. A single lever faucet according to claim 5 in which said plate for mounting said valve body to said escutcheon and said supply conduits to said valve body is a metal plate sealed off from contact with water in said waterways by said sealing means.

7. A single lever faucet according to claim 4 in which said plate for mounting said valve body to said escutcheon and said supply conduits to said valve body is a metal plate sealed off from contact with water in said waterways by said sealing means.

* * * * *